US012157068B2

(12) United States Patent
Puotkalis

(10) Patent No.: US 12,157,068 B2
(45) Date of Patent: Dec. 3, 2024

(54) BRICK

(71) Applicant: Doubleeagle Industry (China) Limited, Hongkong (CN)

(72) Inventor: Martynas Puotkalis, Vilnius (LT)

(73) Assignee: Doubleeagle Industry (China) Limited, Wanchai (CN)

( * ) Notice: Subject to any disclaimer, the term of this patent is extended or adjusted under 35 U.S.C. 154(b) by 159 days.

(21) Appl. No.: 18/095,373

(22) Filed: Jan. 10, 2023

(65) Prior Publication Data

US 2023/0219011 A1 Jul. 13, 2023

(30) Foreign Application Priority Data

Jan. 10, 2022 (DE) ..... 10 2022 100 400.7

(51) Int. Cl.
*A63H 33/08* (2006.01)

(52) U.S. Cl.
CPC ..... *A63H 33/086* (2013.01)

(58) Field of Classification Search
CPC .... A63H 33/06; A63H 33/062; A63H 33/065; A63H 33/08; A63H 33/086
See application file for complete search history.

(56) References Cited

U.S. PATENT DOCUMENTS

| | | | | | |
|---|---|---|---|---|---|
| 3,005,282 | A * | 10/1961 | Godtfred | A63H 33/086 | 446/128 |
| 3,570,170 | A * | 3/1971 | Kishi | A63H 33/086 | 446/128 |
| 4,823,532 | A * | 4/1989 | Westerburgen | A63H 33/08 | 446/128 |
| 5,411,428 | A * | 5/1995 | Orii | A63H 33/042 | 446/128 |
| 5,427,558 | A * | 6/1995 | Knudsen | A63H 33/042 | 446/466 |
| 8,771,032 | B2 * | 7/2014 | Chang | A63H 33/086 | 446/124 |
| 9,814,997 | B1 * | 11/2017 | Vaillancourt | A63H 33/042 | |
| 10,583,368 | B2 * | 3/2020 | Vaillancourt | A63H 33/042 | |
| 2021/0205726 | A1 * | 7/2021 | Long | A63H 33/042 | |

* cited by examiner

*Primary Examiner* — John A Ricci

(57) ABSTRACT

A brick (2) for the plug connection in a plug connection system in a space spanned by a longitudinal direction (4), a transverse direction (6) transverse to the longitudinal direction (4) and a height direction (8) transverse to the longitudinal direction (4) and transverse to the transverse direction (6), including:

a first brick part (10) having an interior space (14) which is bounded by a wall (16) in the longitudinal direction (4) and the transverse direction (6) on both sides and in the height direction (8) on the top side (17), the first brick part (10) having a first plug connection element (18) on the top side (17).

a second brick part (12) having an interior space (26) which is bounded by a wall (28) in the longitudinal direction (4).

17 Claims, 2 Drawing Sheets

BRICK

CROSS-REFERENCE TO RELATED APPLICATION

This application claims priority from the Germany patent application 102022100400.7 filed Jan. 10, 2021, the content of which is incorporated herein in the entirety by reference.

TECHNICAL FIELD

The present disclosure relates to a brick.

BACKGROUND

The homepage http://www.bricklink.com lists under part number 731c04 (alternative part number: 4255c04 and 76537) a brick in the form of a spring leg for plug connection in a plug connection system in a space which is spanned by a longitudinal direction, a transverse direction transverse to the longitudinal direction and a height direction transverse to the longitudinal direction and transverse to the transverse direction. The known brick comprises a first brick part having a first plug connection element on the upper side, and a second brick part having an interior space which is bounded by a wall in the longitudinal direction and the transverse direction on both sides and in the height direction on the bottom side, the second brick part having a second plug connection element on the bottom side. The second brick part is larger than the first brick part both in the longitudinal direction and in the transverse direction, the first brick part being telescopically pushed into the interior space of the second brick part against the height direction. The two brick parts are supported against each other by a common resetting element.

SUMMARY

It is object of the disclosure to improve the known brick.

The task is fulfilled by the characteristics of the independent claims. Preferred embodiments are the subject matter of the dependent claims.

According to one aspect of the disclosure, a brick for plug connection in a plug connection system in a space which is spanned by a longitudinal direction, a transverse direction transverse to the longitudinal direction and a height direction transverse to the longitudinal direction and transverse to the transverse direction, comprises:

a first brick part having an interior space which is bounded by a wall in the longitudinal direction and the transverse direction on both sides and in the height direction on the upper side, the first brick part having a first plug connection element on the upper side, a second brick part having an interior space which is bounded by a wall in the longitudinal direction and the transverse direction on both sides and in the height direction on the bottom side, the second brick part having a second plug connection element on the bottom side which can be connected to the first plug connection element by plugging, wherein the second brick part is formed larger than the first brick part both in the longitudinal direction and in the transverse direction, wherein the first brick part is telescopically pushed into the interior space of the second brick part against the height direction, and wherein the two brick parts being supported against each other by a common resetting element arranged in the interior spaces.

The specified brick is based on the consideration that the known brick as a spring leg is very slim, but also has a very individual design. It cannot be installed with other bricks without further coupling elements because the two plug connectors are not of complementary design. This is where the specified brick comes into play with the idea of cutting open a brick with grid dimensions according to Hilary Page and used since 1955 by the Lego A/S company and mounting the two parts so that they can be moved telescopically against each other via a spring. Such a brick is not only fully compatible with the grid dimension, it can also be connected to other bricks defined according to this grid dimension without further coupling elements.

In a further embodiment of the specified brick, the wall of the second brick part has, on its surfaces facing the interior space, brick part form fit elements directed into the interior space, which guide the first brick part in the height direction and block a movement of the first brick element in the longitudinal direction and the transverse direction. In this way, the friction between the two brick parts can be reduced during the telescopic movement.

In another embodiment of the specified brick, a relative movement path of the first brick part in the second brick part in the height direction is limited by a limiting device. In this way, not only can both brick parts be prevented from unintentionally disengaging from each other, but the two brick parts can also be supported against each other with a definable preload.

In an additional embodiment of the specified brick, the limiting device comprises a snap-fit connection of a first hook formed on the wall of the first brick part directed outwardly as seen from the interior space and a second hook formed on the wall of the second brick part directed inwardly as seen from the interior space. In this way, the movement limitation between both brick parts in the height direction can be produced detachably.

In a further embodiment of the specified brick, the wall of the first brick part adjacent to the first hook is slotted. The elasticity of the first hook can then be adjusted by the width of the slot, so that the movement limitation can be designed to be sufficiently mechanically stable on the one hand, but still remains detachable.

In a further embodiment of the specified brick, the wall of the second brick part has an access opening on the bottom side in the area of the second hook towards the interior space, via which the hooks are then accessible in order to detach the movement limitation in a simple manner.

In another embodiment of the specified brick, the resetting element is a spring that can not only be manufactured inexpensively but can also be realized with any desired elasticity.

In a particular embodiment, the specified brick comprises a guiding sleeve in which the spring is guided in the height direction. In this way, unintentional buckling of the spring is avoided, as a result of which the resetting function of the spring would no longer be given.

In a preferred embodiment, the guiding sleeve is attached to the first brick part or to the second brick part. In this way, the spring can be mounted stably in the interior space between the two brick parts on one of the two brick parts.

In a particularly preferred embodiment of the specified brick, hook form fit elements are formed on the guiding sleeve, which guide a hook in the height direction and restrict a movement of the hook towards the guiding sleeve.

In this way, overstretching of the above-mentioned hooks is avoided.

BRIEF DESCRIPTION OF THE DRAWINGS

The above-described properties, features and advantages of this disclosure, as well as the manner in which they are achieved, will become clearer in connection with the following description of the embodiments, which are explained in more detail in connection with the drawing, in which.

DETAILED DESCRIPTION

In the figures, the same technical elements are provided with the same reference signs, and are only described once. The figures are purely schematic and, in particular, do not reflect the actual geometric proportions.

Figure 1:
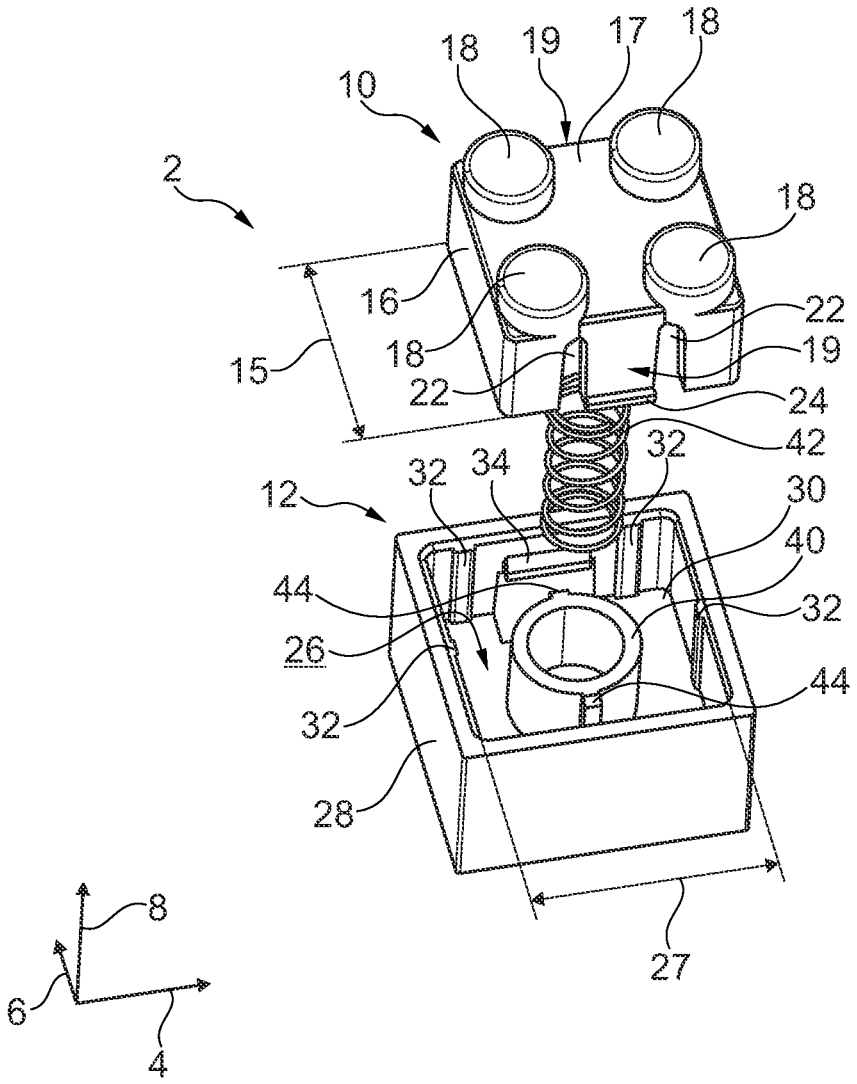
FIG. 1 is an exploded view of a brick from a first perspective.
Figure 2:
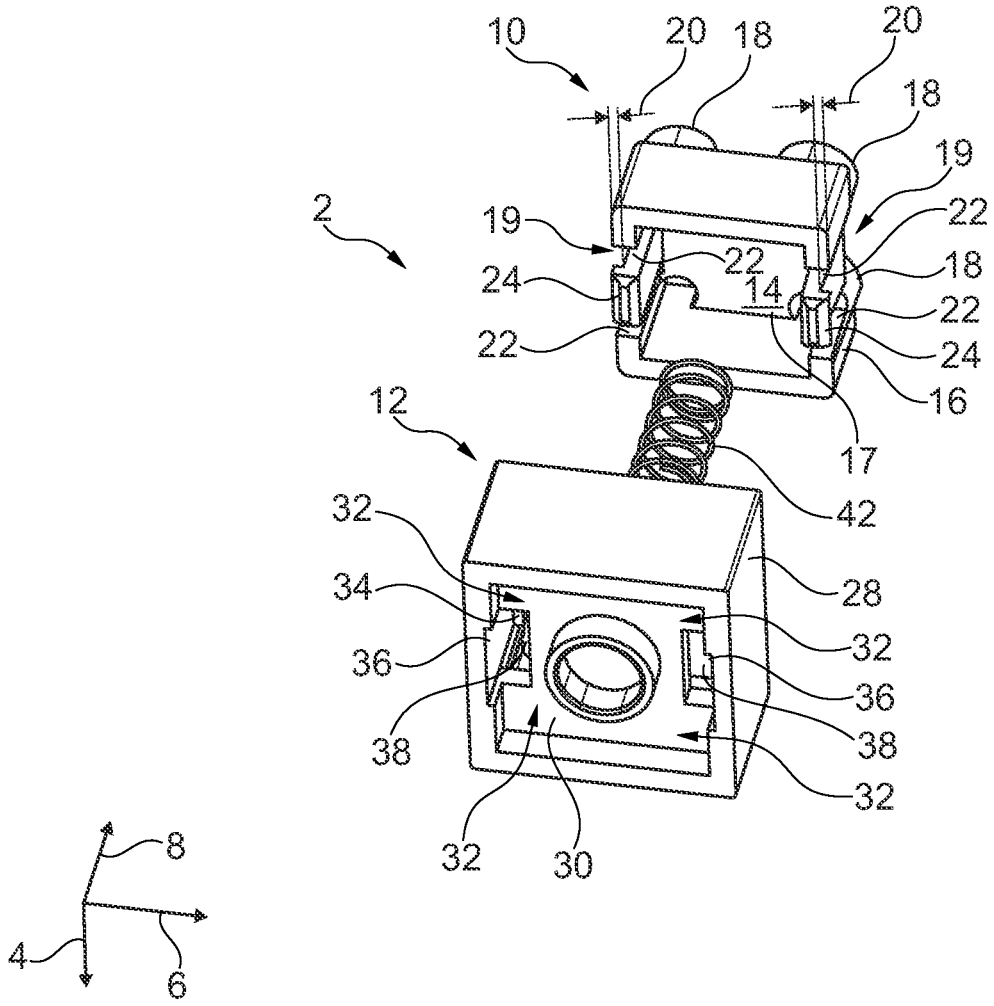
FIG. 2 is an exploded view of the brick of FIG. 1 from a second perspective.

Reference is made to FIGS. 1 and 2, which show from two different perspectives a brick 2 for plug connection in a plug connection system not shown in any further detail in a space spanned by a longitudinal direction 4, a transverse direction 6 transverse to the longitudinal direction 4 and a height direction 8 transverse to the longitudinal direction 4 and transverse to the transverse direction 6.

The brick 2 comprises a first brick part 10 and a second brick part 12.

The first brick part 10 has an interior space 14 which is bounded in and against the longitudinal direction 4 and in the transverse direction 6 by a wall 16 which, in cross section viewed from the height direction 8, forms a square with an edge length 15. For the sake of clarity, the edge length 15 is only indicated in FIG. 1. In the height direction 8, the interior space 14 of the first brick part 10 is bounded by a top side 17 on whose upper side first plug connection elements in the form of studs 18 are formed. The studs 18 are formed in size and spacing according to the Lego grid dimension, as described, for example, in the disclosure of Pawel Sariel Kmiec, The Unofficial LEGO Technic Builders Guide, No Starch Press; $2^{nd}$ edition (Oct. 1, 2016), ISBN: 978-1593277604. For further information on the Lego grid dimension, reference is made to the relevant literature thereon.

The wall 16 of the first brick part 10 has a recessed wall section 19 on each side, as viewed in the transverse direction 6, which is arranged centrally as viewed in the longitudinal direction 4 and is directed towards the interior space 14. The recessed wall section 19 is recessed into the wall 16 with a recess depth 20. For the sake of clarity, the recess depth 20 is only indicated in FIG. 2. The recessed wall section 19 is delimited from the rest of the wall 16 by slots 22 and has a hook 24 on its bottom side viewed in the height direction 8.

Analogous to the first brick part 10, the second brick part 12 also has an interior space 26, which is bounded in and against the longitudinal direction 4 and in the transverse direction 6 by a circumferential wall 28. The interior space 26 of the second brick part 12 is formed in its cross-section seen from the height direction 8 in the form of a square with an edge length 27. Opposite to the height direction 8, the interior space 26 of the second brick part 12 is bounded by a bottom side 30 on the bottom side of which second plug connection elements in the form of studs receptacles 32 are formed, as are known in principle from the disclosure U.S. Pat. No. 3,005,282 A. The geometry of the stud receptacles 32 is adapted to the studs 18 according to the Lego grid dimension.

The edge length 15 of the square first brick part 10 is selected to be smaller than the edge length 27 of the square interior space 26 of the second brick part 12, so that the first brick part 10 can be telescopically inserted into the interior space of the second brick part 12. To reduce friction between the two brick parts 10, brick form fit elements 32 may be formed on one of the walls 16, 28 of one brick part 10, 12 to restrict movement of the corresponding other brick part 12, 10 in the longitudinal direction 4 and the transverse direction 6.

In the present embodiment, these brick form fit elements 32 are formed on the wall 28 directed into the interior space 26 of the second brick part 12. In this regard, as viewed in the longitudinal direction 4, two brick form fit elements 32 are arranged on each side of the above-mentioned square, while as viewed in the transverse direction 6, only one brick form fit element 32 is arranged on each side of the above-mentioned square. In principle, a single brick form fit element 32 is sufficient on each side to achieve the desired engagement in the longitudinal and transverse directions 4, 6 and thus guidance in the height direction 8. The arrangement of two brick form fit elements 32 on one side is recommended, however, so that stable guidance can be achieved between the two brick parts 10, 12 despite the hook 24 on the first brick part 10.

A hook 34 is formed on the wall 28 of the second brick part 12 on each side of the square with two brick form fit elements 32, and a guide channel 36 is connected to the bottom side of the hook as seen in the height direction 8. If the first brick part 10 is pushed telescopically into the interior space 26 of the second brick part 12 against the height direction 8, the hooks 24, 34 of the respective brick parts 10, 12 are thereby aligned with one another. From a certain insertion depth of the first brick part 10 into the second brick part 12, the hooks 24 of the first brick part 10 snap over the hooks 34 of the second brick part 12 and thus form a positive connection in the height direction 8, so that the first brick part 10 can no longer be detached from the interior space 26 of the second brick part. In order to be able to release this positive connection in the height direction 8, the second brick part 12 has an access opening 38 on its bottom side 30 on each side of the square with two brick form fit elements 32, through which a lever not shown further can be pushed and the hook 24 of the first brick part 10 can be lifted in or against the transverse direction 6. Then the first brick part 10 can be released again from the interior space 26 of the second brick part in the height direction 8.

Furthermore, a guiding sleeve 40 is arranged on the bottom side 30 of the second brick part 12. A resetting element in the form of a spring 42 can be inserted into this guiding sleeve 40, which serves as a resettable spacer between the top side 17 of the first brick part 10 and the bottom side 30 of the second brick part 12. The length of the spring 42 has to be dimensioned such that when the hooks 24, 34 abut one another in the height direction 8, the spring 42 is subjected to a predetermined pre-stressing force. If a force is applied to the top side 17 in the direction opposite to the height direction 8, the first brick part 10 is pressed further into the interior space 26 of the second brick part 12. When the force is released, the spring 42 moves the first brick part 10 back out of the interior space 26 of the second brick part 12 until the hooks 24, 34 strike against each other again in the height direction. In this way, a damping function can be achieved that can be scaled as desired by stacking or arranging multiple bricks 2 side by side, because a parallel arrangement of the bricks 2 increases the overall spring constant and a row arrangement of the bricks 2 reduces overall spring constant.

In principle, the guiding sleeve 40 can be loosely arranged between the top side 17 of the first brick part 10 and the bottom side 30 of the second brick part 12. However, it is preferably attached to either the top side 17 of the first brick part 10 or the bottom side 30 of the second brick part 12. In the present embodiment, the guiding sleeve 40 is attached to the bottom side 30 of the second brick part 12 and further has shoulder-shaped hook form fit elements 44 directed towards the hooks 34 of the second brick part 12. In this way, a space for motion of the hooks 24 of the first brick part between each hook 34 of the second brick part 12 and the corresponding hook form fit element 44 can be defined, for example, to prevent overstretching.

To assemble the brick 2 as shown in FIGS. 1 and 2, the spring 42 is first inserted into the guiding sleeve 40 on the bottom side 30 of the second brick part 12. Then, the first brick part 10 is inserted into the interior space 26 of the second brick part 12 with its hooks 24 first and aligned with the hooks 34 of the second brick part 12 until the hooks 24, 34 lock into each other. Thereafter, the brick 2 can be used, for example, as a damping element in a higher-level brick model.

The invention claimed is:

1. A brick (2) for a plug connection in a plug connection system in a space spanned by a longitudinal direction (4), a transverse direction (6) transverse to the longitudinal direction (4) and a height direction (8) transverse to the longitudinal direction (4) and transverse to the transverse direction (6), comprising:

a first brick part (10) having an interior space (14) which is bounded by a wall (16) in the longitudinal direction (4) and the transverse direction (6) on both sides and in the height direction (8) on a top side (17), the first brick part (10) having a first plug connection element (18) on the top side (17), a second brick part (12) having an interior space (26) which is bounded by a wall (28) in the longitudinal direction (4) and the transverse direction (6) on both sides and in the height direction (8) on a bottom side (30), the second brick part (12) having a second plug connection element (32) on the bottom side (30) which can be plugged in to the first plug connection element (18), wherein the second brick part (12) is formed larger than the first brick part (10) both in the longitudinal direction (4) and in the transverse direction (6), wherein the first brick part (10) is telescopically pushed into the interior space (26) of the second brick part (12) against the height direction (8), and wherein the two brick parts (10, 12) being supported against each other by a common resetting element (42) arranged in the interior spaces (14, 26).

2. The brick (2) according to claim 1, wherein the wall (28) of the second brick part (12) has, on its surfaces facing the interior space (26), brick part form fit elements (32) directed into the interior space, which guide the first brick part (10) in the height direction (8) and block a movement of the first brick part (10) in the longitudinal direction (4) and the transverse direction (6).

3. The brick (2) according to claim 2, wherein a relative movement path of the first brick part (10) in the second brick part (12) in the height direction (8) is limited by a limiting device (24, 34).

4. The brick (2) according to claim, 2 wherein the resetting element (42) is the spring.

5. The brick (2) according to claim 1, wherein a relative movement path of the first brick part (10) in the second brick part (12) in the height direction (8) is limited by a limiting device (24, 34).

6. The brick (2) according to claim 5, wherein the limiting device (24, 34) comprises a snap-fit connection comprising a first hook (24) formed on the wall (16) of the first brick part (10) directed outwardly as seen from the interior space (14) and a second hook (34) formed on the wall (28) of the second brick part (12) directed inwardly as seen from the interior space (26).

7. The brick (2) according to claim 6, wherein the wall (16) of the first brick part (10) adjacent to the first hook (24) is slotted (22).

8. The brick (2) according to claim 7, wherein the wall (28) of the second brick part (12) has an access opening (38) on the bottom side (30) in the area of the second hook (34) towards the interior space (26).

9. The brick (2) according to claim, 7 wherein the resetting element (42) is the spring.

10. The brick (2) according to claim 6, wherein the wall (28) of the second brick part (12) has an access opening (38) on the bottom side (30) in the area of the second hook (34) towards the interior space (26).

11. The brick (2) according to claim, 10 wherein the resetting element (42) is the spring.

12. The brick (2) according to claim, 6 wherein the resetting element (42) is the spring.

13. The brick (2) according to claim, 5 wherein the resetting element (42) is the spring.

14. The brick (2) according to claim, 1 wherein the resetting element (42) is a spring.

15. The brick (2) according to claim 14, comprising a guiding sleeve (44), in which the spring (42) is guided in the height direction (8).

16. The brick (2) according to claim 15, wherein the guiding sleeve (40) is attached to the first brick part (10) or to the second brick part (12).

17. The brick (2) according to claim 16, wherein hook form fit elements (44) are formed on the guiding sleeve (40), which guide a hook (24) in the height direction and restrict a movement of the hook (24) towards the guiding sleeve (40).

* * * * *